US006400324B1

(12) United States Patent
Macias

(10) Patent No.: US 6,400,324 B1
(45) Date of Patent: Jun. 4, 2002

(54) AUTOMATICALLY ORIENTED ANTENNA FOR A HAND-HELD COMMUNICATION DEVICE

(75) Inventor: Juan H. Macias, Margate, FL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/754,752

(22) Filed: Jan. 4, 2001

(51) Int. Cl.[7] ..... H01Q 1/24

(52) U.S. Cl. ..... 343/702; 343/872; 343/882

(58) Field of Search ..... 343/700 MS, 702, 343/765, 882, 872; H01Q 3/00, 1/24

(56) References Cited

U.S. PATENT DOCUMENTS 5,990,846 A * 11/1999 Dichter ..... 343/702

* cited by examiner

*Primary Examiner*—Michael C. Wimer
(74) *Attorney, Agent, or Firm*—Ingrassia Fisher & Lorenz; Frank J. Bogacz

(57) ABSTRACT

A hand-held communication device with an automatically oriented antenna fixed thereto and including a closed container at least partially filled with liquid. A floating element including a patch antenna is positioned within the cavity and carried by the liquid so as to maintain the patch antenna in a continuous orientation. An electrical coupling is formed between the patch antenna and the hand-held communication device to operatively couple the patch antenna for receiving transmissions in the hand-held communication device.

14 Claims, 1 Drawing Sheet

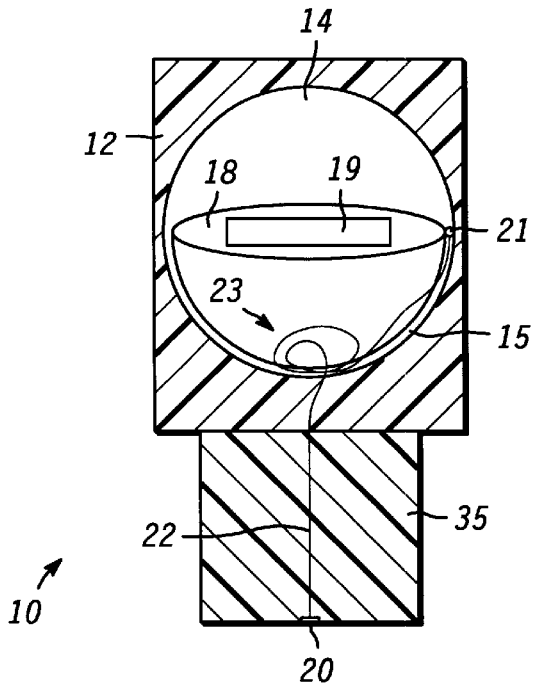
FIG. 1
FIG. 2
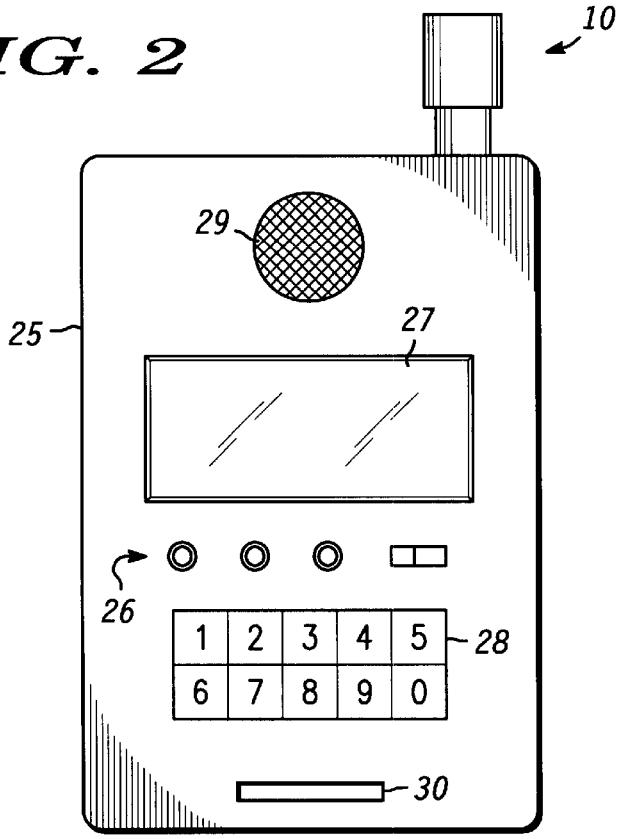

AUTOMATICALLY ORIENTED ANTENNA FOR A HAND-HELD COMMUNICATION DEVICE

FIELD OF THE INVENTION

This invention relates to communication apparatus requiring an antenna with a specific orientation and more particularly to automatically oriented antennas.

BACKGROUND OF THE INVENTION

At the present time, hand-held communication devices, such as remote telephones, cellular telephones, two-way radios, etc. are very popular. Further, hand-held communication devices are generally very small so that they can be conveniently carried and operated. Very small hand-held devices dictate the use of low power. To maximize the transmission of a signal from a transmitter to a remote receiver in low power conditions, it is often expedient to provide a polarized antenna pattern. In such conditions the received signal is maximized by orienting the receiver antenna in accordance with the transmitted polarized signal.

As an example, many receivers that are constructed to receive transmitted signals from satellites operate most effectively when their antennas are oriented vertically and/or in a specific horizontal orientation. In these situations, either the receiver must have a swivel antenna that can be oriented vertically as the user places the receiver in a normal position adjacent his ear or the orientation of the entire receiver is adjusted for best reception and the user operates the receiver as best he can.

Accordingly it is highly desirable to provide automatically oriented antennas in hand-held communication devices requiring an antenna with a specific orientation.

BRIEF DESCRIPTION OF THE DRAWINGS

Referring to the drawings:

FIG. 1 is a cross-sectional view of an automatically oriented antenna in accordance with the present invention, portions thereof broken away to illustrate internal features; and FIG. 2 is a front view of a communication device having the automatically oriented antenna of FIG. 1 operatively attached thereto.

DESCRIPTION OF THE PREFERRED EMBODIMENT

Referring to FIG. 1, an automatically oriented antenna, generally designated 10, is illustrated. Automatically oriented antenna 10 is designed for use with a hand-held communication device. A closed container or housing 12 is constructed to define an inner cavity 14 at least partially filled with fluid. In a preferred embodiment, cavity 14 is spherical and is at least partially filled with a non-conductive liquid 15. Generally, housing 12 can be easily and conveniently fabricated in two parts as, for example, by molding from plastic or the like. The two parts are then assembled, by friction fitting, threading, bonding, etc. to form the complete inner cavity 14.

A floating element 17 is positioned within cavity 14 and carries. Element 17 is formed as a portion of a sphere (e.g. semisphere, hemisphere, etc.) with a diameter slightly smaller than the diameter of spherical cavity 14. In this preferred embodiment, element 17 has a surface 18 which carries an antenna element 19 thereon. Cavity 14 is at least partially filled with non-conductive liquid 15 which floats element 17 in cavity 14 for free movement so as to maintain a continuous orientation for surface 18 and antenna element 19. Generally, if floating element 17 is hemispherical, the lower portion will provide sufficient weight to maintain an orientation in which surface 18 is generally horizontal.

In this preferred embodiment, antenna element 19 is a well known patch antenna mounted on upper surface 18 of floating element 17. It will be understood by those skilled in the art that different antenna elements may be utilized and incorporated directly into floating element 17 as, for example, by molding floating element 17 around all or a portion of antenna element 19. It will of course be understood that one or more pieces of weighted material can be included in floating element 17 (e.g., during molding) to ensure a good orientation. Also, other configurations for floating element 17 and/or cavity 14 can be devised to provide the continuous orientation, if desired. For example, floating element 17 can be completely spherical with weights included to provide the desired orientation. In a different embodiment, floating element 17 can be disk shaped with weights or gas bubbles incorporated to ensure a desired orientation.

An electrical contact between antenna element 19 and an external terminal 20 is provided by a conductive bead 21 and a very thin conductive wire 22. Conductive wire 22 is positioned in cavity 14 and is provided with sufficient slack (e.g., coil 23) to allow free movement of floating element 17 without interference from wire 22. It will of course be understood that stops and the like (not shown) can be included in cavity 14 to prevent continuous rotary movement of floating element 17 and subsequent entangling of wire 23. Such stops and the like can provide for sufficient movement of floating element 17 within cavity 14 (e.g., at least 180° about any axis) to allow the desired orientation of antenna element 19.

Referring additionally to FIG. 2, a simplified hand-held communication device 25 is illustrated, which may be any of the well known communication devices presently used and including but not limited to remote telephones, cellular phones, two-way radios, any devices communicating with satellites, etc. As is understood in the art, device 25 includes a plurality of controls 26, such as an on/off switch, amplitude control, etc., a display 27 for numbers called, messages, etc., an alpha-numeric input such as key board 28, a speaker 29, and a microphone 30. Because of the positions of speaker 29, which is generally placed in the vicinity of the ear, and microphone 30, which must be placed near the mouth, device 25 will generally be positioned at approximately 45° to the horizontal during use. Thus, if a fixed antenna is mounted on device 25 it will generally be oriented at 45° to the horizontal.

In the embodiment illustrated in FIG. 2, automatically oriented antenna 10 of FIG. 1 is mounted on device 25. Housing 12 of automatically oriented antenna 10 is formed with a portion 35 having a reduced outer dimension so as to allow for easy mounting on device 25. Portion 35 can be, for example, simply plugged into an aperture in the housing of device 25 and frictionally engaged. Wire 20 extends the length of portion 35 (see FIG. 1) and is attached at the bottom surface to external terminal 20 which engages a terminal in an aperture in device 25 for a firm electrical contact.

Thus, with automatically oriented antenna 10 fixedly engaged with device 25 as illustrated in FIG. 2, device 25 can be tilted at any angle convenient for use and antenna element 18 within automatically oriented antenna 10 will remain at a desired orientation. Further, antenna element 18 is completely enclosed so that external conditions (e.g., weather, dirt, striking outside objects, etc.) cannot effect the movable parts and prevent the normal automatic orientation. Also, antenna element 18 is relatively easily manufactured and installed.

While we have shown and described specific embodiments of the present invention, further modifications and improvements will occur to those skilled in the art. We desire it to be understood, therefore, that this invention is not limited to the particular forms shown and we intend in the appended claims to cover all modifications that do not depart from the spirit and scope of this invention.

What is claimed is:

1. An automatically oriented antenna for a hand-held communication device comprising:

a housing defining a substantially spherical inner cavity at least partially filled with fluid;

a substantially hemispherical floating element having a substantially flat upper surface having a periphery which is joined by a lower substantially spherical surface positioned within the inner cavity and carried by the fluid so as to maintain a continuous orientation, the floating element including a continuously oriented antenna, and an electrical contact external to the housing and electrically coupled to the antenna.

2. An automatically oriented antenna as claimed in claim 1 wherein the floating element is weighted to maintain the continuous orientation.

3. An automatically oriented antenna as claimed in claim 2 wherein said substantially flat surface carrying a patch antenna.

4. An automatically oriented antenna as claimed in claim 3 wherein the substantially hemispherical element has a diameter smaller than an inner diameter of the substantially spherical inner cavity.

5. An automatically oriented antenna as claimed in claim 1 wherein the fluid is non-conductive.

6. An automatically oriented antenna with a hand-held communication device comprising:

a hand-held communication device;

a closed substantially spherical container at least partially filled with fluid, the closed container being fixedly mounted on the hand-held communication device;

a substantially hemispherical floating element having a substantially flat upper surface the periphery of which is joined to a substantially spherical lower surface positioned within a cavity and carried by the fluid so as to maintain a continuous orientation, the floating element including a continuously oriented antenna; and an electrical coupling between the antenna and the hand-held communication device operatively coupling the antenna for receiving transmissions in the hand-held communication device.

7. An automatically oriented antenna with a hand-held communication device as claimed in claim 6 wherein the floating element is weighted to maintain the continuous orientation.

8. An automatically oriented antenna with a hand-held communication device as claimed in claim 7, said substantially flat surface carrying a patch antenna.

9. An automatically oriented antenna wit a hand-held communication device as claimed in claim 8 wherein the substantially hemispherical element has a diameter smaller than an inner diameter of a substantially spherical internal cavity.

10. An automatically oriented antenna with a hand-held communication device as claimed in claim 6 wherein the fluid is non-conductive.

11. An automatically oriented antenna with a hand-held communication device comprising:

a hand-held communication device sensitive to antenna orientation;

a closed container defining an internal spherical cavity at least partially filled with liquid, the closed container being fixedly mounted on the hand-held communication device;

a substantially hemispherical floating element with a generally circular cross section having a diameter smaller than an inner diameter of the internal spherical cavity, the floating element having a substantially flat upper surface having a periphery joined by a substantially spherical lower surface and positioned within the internal spherical cavity and carried by the fluid so as to maintain a continuous orientation, the floating element including a continuously oriented patch antenna; and an electrical coupling between said patch antenna and the hand-held communication device operatively coupling the patch antenna for receiving transmissions in the hand-held communication device.

12. An automatically oriented antenna with a hand-held communication device as claimed in claim 11 wherein the floating element is weighted to maintain the continuous orientation.

13. An automatically oriented antenna with a hand-held communication device as claimed in claim 11 wherein said substantially flat surface carries the patch antenna.

14. An automatically oriented antenna with a hand-held communication device as claimed in claim wherein the liquid is non-conductive.

* * * * *